US005125637A

United States Patent [19]

Glaser

[11] Patent Number: 5,125,637

[45] Date of Patent: Jun. 30, 1992

[54] FEEDING MECHANISM FOR NEWSPAPER COMPILER HAVING A MOVABLE VACUUM VALVE ASSEMBLY

[75] Inventor: Donald A. Glaser, Emporia, Kans.

[73] Assignee: Kansa Corporation, Emporia, Kans.

[21] Appl. No.: 750,452

[22] Filed: Aug. 27, 1991

[51] Int. Cl.[5] ..... B65H 3/08

[52] U.S. Cl. ..... 271/11; 271/100; 271/108; 271/107

[58] Field of Search ..... 271/11, 12, 96, 99, 271/100, 107, 108

[56] References Cited

U.S. PATENT DOCUMENTS

| | | | |
|---|---|---|---|
| 1,668,292 | 5/1928 | Spiess | 271/108 |
| 3,069,025 | 12/1962 | Winkler et al. | 271/96 |
| 3,658,319 | 4/1972 | Glaser | 271/100 |
| 4,279,412 | 7/1981 | Glatz | 271/108 |
| 4,436,300 | 3/1984 | Goi | 271/108 |

FOREIGN PATENT DOCUMENTS

| | | | |
|---|---|---|---|
| 21320 | 2/1980 | Japan | 271/108 |
| 21354 | 2/1980 | Japan | 271/108 |
| 225040 | 9/1988 | Japan | 271/107 |

*Primary Examiner*—D. Glenn Dayoan
*Assistant Examiner*—Steven M. Reiss
*Attorney, Agent, or Firm*—Hovey, Williams, Timmons & Collins

[57] ABSTRACT

A feeder for flexible sheet material includes a gripping assembly (30) provided with a hollow gripper shaft (54) and a vacuum operated gripper (52). The shaft (54) is movable through an arcuate path of travel between engagement and sheet-releasing positions. The vacuum pressure to the gripper (52) is controlled to cause the marginal portion of the lowermost sheet to be gripped by the gripper when the shaft is in the engagement position and to discontinue the vacuum to the gripper at the sheet-releasing position. A valve assembly (64) is disposed between a vacuum line and the hollow shaft (54) and is mounted for rotation on the gripping assembly (30). The valve is rotatable between open and closed positions in response to movement of the shaft through the arcuate path of travel between the engagement and sheet-releasing positions.

11 Claims, 3 Drawing Sheets

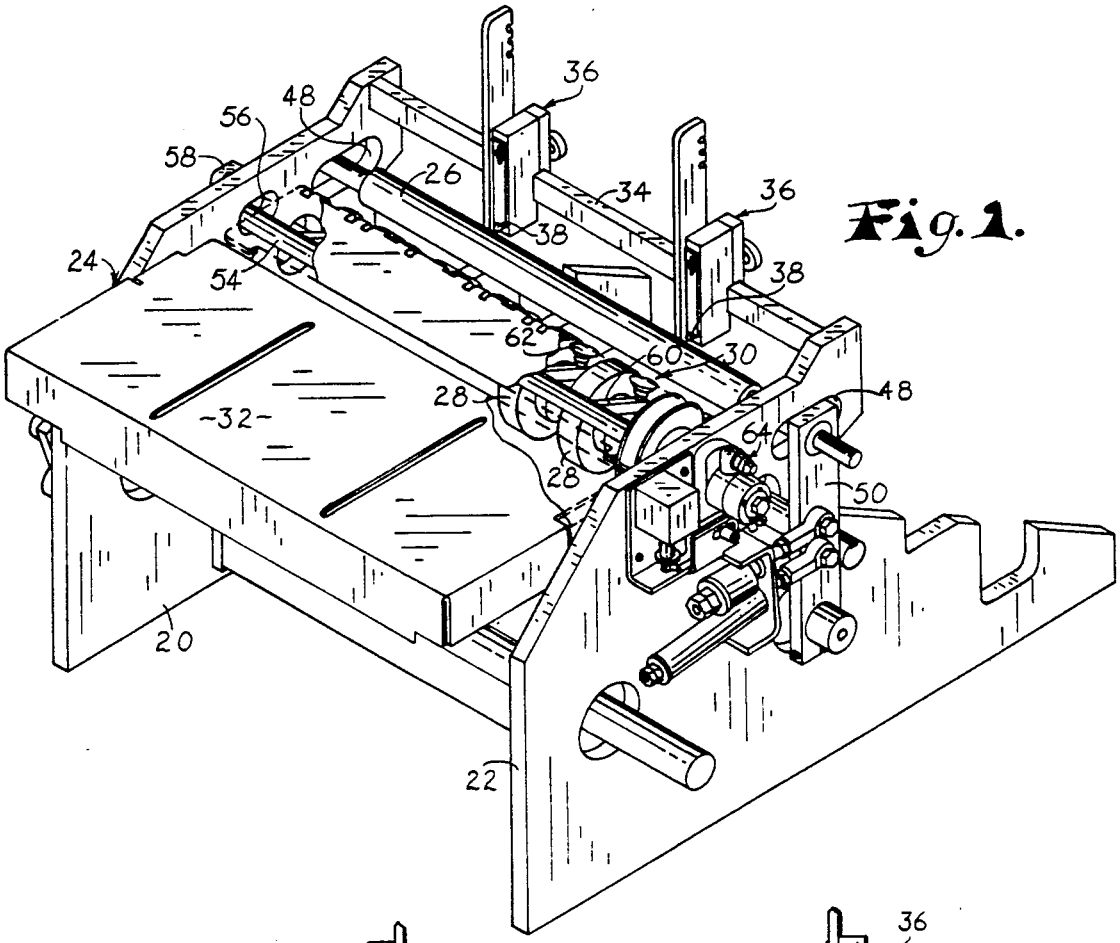
Fig. 1.
Fig. 2.
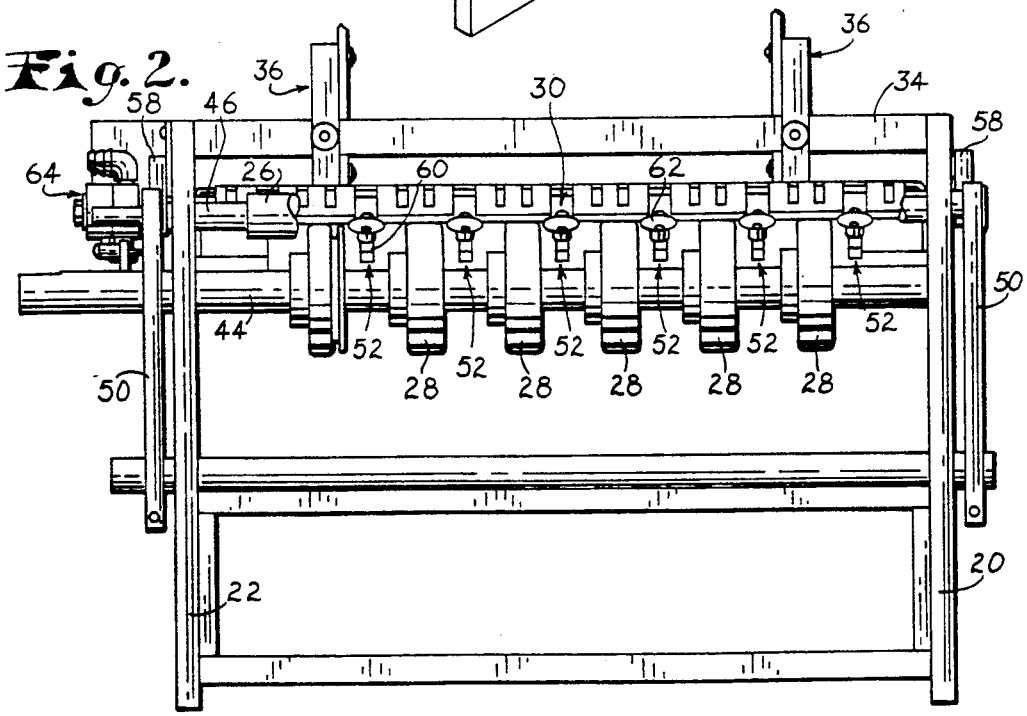

FEEDING MECHANISM FOR NEWSPAPER COMPILER HAVING A MOVABLE VACUUM VALVE ASSEMBLY

BACKGROUND OF THE INVENTION

1. Field of the Invention

The present invention relates generally to machines for handling sheets of flexible material and, more particularly, to an apparatus for successively feeding single or multiple sheet newspaper sections from a stack thereof to a delivery station or to an awaiting preopened newspaper for insertion into the newspaper.

2. Discussion of the Prior Art

A feeding system for delivering multiple sheet newspaper sections to a delivery station is disclosed in U.S. Pat. No. 3,658,319, issued to Glaser on Apr. 25, 1972. This known system employs a vacuum assembly to initially grip a marginal portion of a lowermost sheet or section and, without actually withdrawing the section, to bend the gripped portion and introduce the portion into a mechanical conveying unit for delivery to an awaiting newspaper section.

The vacuum system employed in the device illustrated in U.S. Pat. No. 3,658,319, actuates a gripper in timed response to the extension and retraction of the gripper into and out of contact with the lowermost sheet or section. A valve apparatus is provided in the device which provides the timing of the vacuum pressure to the gripper, and includes a control plate component which pivots relative to the gripper assembly between positions turning the vacuum pressure to the gripper on and off.

This construction is advantageous in that the valve is located immediately adjacent the gripper so that the vacuum pressure is quickly transmitted to the gripper upon opening of the valve, and in that the movement of the valve is carried out by the gripper assembly as the assembly moves between engagement and sheet-releasing positions. However, it would be desirable to improve upon the valve construction in order to reduce the amount of movement of the valve, and to increase the useful life of the valve while decreasing the size and cost thereof as well as the number of parts required.

In another known construction in which a feeder system employs a vacuum operated gripper assembly to introduce a sheet or section into a mechanical conveying unit for delivery to an awaiting newspaper section, the vacuum assembly includes a valve apparatus that is constructed as a separate unit from the gripper assembly and is mounted away from the gripper assembly. According to this known construction, the valve apparatus is operated independently of the gripper assembly and is connected to the gripper assembly by a conduit extending therebetween which must be evacuated each time the vacuum pressure is connected to the gripper assembly.

Several drawbacks exist with this conventional construction. For example, because the valve is remote from the gripper assembly, an increased volume of space must be evacuated each time the vacuum pressure is connected to the gripper assembly such that a delay occurs between the time at which the valve moves to the open position and the time at which suction is experienced at the gripper. In devices where feeding rates are below 10,000 operations per hour, such delays are not critical. However, where more than 15,000 operations per hour are to be carried out, such as in an apparatus constructed in accordance with the present invention, such delays become significant and adversely effect the ability of the gripper to feed the lowermost sheet or section.

Another drawback of the conventional construction in which a remote valve is used resides in the inability of such a remote valve to be operated directly by the movement of the gripper between an engagement and sheet-releasing position. This type of construction requires additional structure to control the timing of operation of the remote valve.

OBJECTS AND SUMMARY OF THE INVENTION

It is an object of the present invention to provide a feeder for feeding sheet material from a receptacle to a delivery station without the necessity for a complex valve arrangement for connecting a vacuum operated gripper assembly to a vacuum supply source.

Another object of the present invention is to provide a feeder having a valve mounted directly on the gripper assembly and being rotatable relative to the assembly during movement of the assembly between engagement and sheet releasing positions thereof.

Further, the present invention seeks to provide a feeder in which the timing of activation of a vacuum operated gripper is controlled by movement of the gripper assembly and is adjustable to permit variations thereof.

In accordance with these and other objects, a feeder constructed in accordance with the present invention includes a gripping assembly provided with a hollow gripper shaft and a vacuum operated gripper. The shaft is movable through an arcuate path of travel between engagement and sheet-releasing positions. The vacuum pressure to the gripper is controlled to cause the marginal portion of the lowermost sheet to be gripped by the gripper when the shaft is in the engagement position and to discontinue the vacuum to the gripper at the sheet releasing position. A valve is disposed between a vacuum line and the hollow shaft and is rotatable between open and closed positions in response to movement of the shaft through the arcuate path of travel between the engagement and sheet-releasing positions.

By providing this construction, numerous advantageous results are achieved. For example, by providing a valve which is rotatably supported directly on the gripping assembly, the movement of the gripping assembly between engagement and sheet releasing positions may be utilized to carry out rotation of the valve between open and closed positions. In this manner, timing of the valve rotation is controlled directly by the gripper movement, and the gripping assembly actually forms a part of the valve so as to reduce the number of parts required.

First and second stops are preferably provided on the feeder and are positioned within the path of travel of an arm provided on the valve such that the arm engages the stops during movement of the gripping assembly to carry out rotation of the valve between the open and closed positions. The position of these stops within the path of travel is adjustable in order to permit variation in the timing of connection of the gripper to the vacuum pressure.

Also, stop moving means may be provided for moving one of the stops out of the path of travel of the arm so as to deactivate the vacuum pressure when normally the pressure would be applied. By providing this feature, it is possible to move the gripping assembly into the engagement position without connecting the gripper to the vacuum pressure such that the gripping assembly moves back toward the sheet releasing position without having engaged the lowermost sheet in the receptacle.

BRIEF DESCRIPTION OF THE DRAWING FIGURES

A preferred embodiment of the present invention is described in detail below with reference to the attached drawing figure, wherein:

FIG. 1 is a perspective view of a feeder constructed in accordance with the preferred embodiment of the present invention;

FIG. 2 is a front elevational view of the feeder;

DETAILED DESCRIPTION OF THE PREFERRED EMBODIMENT

Figures 3, 4, 5, 6, 13:
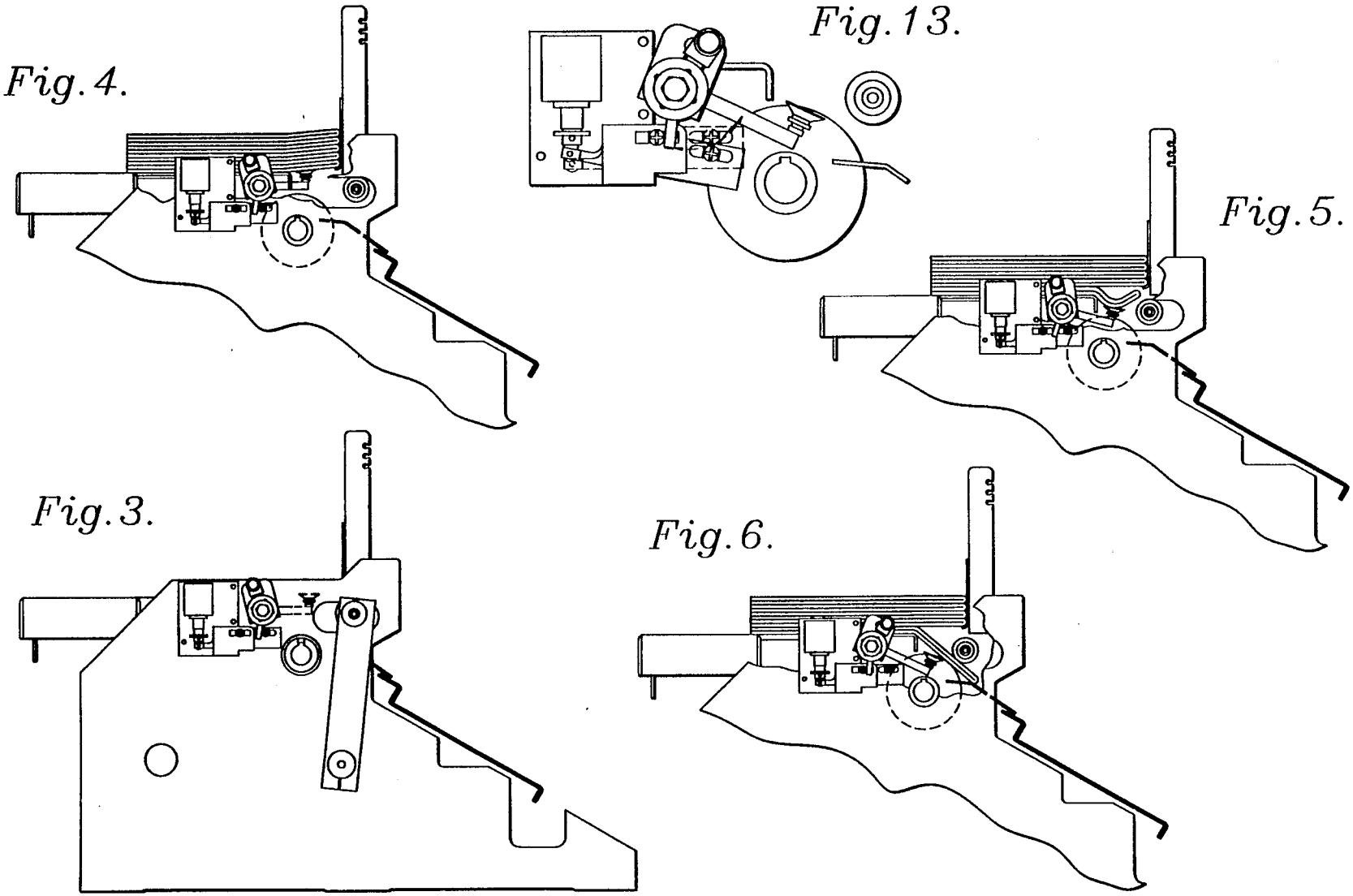
FIG. 3 is a schematic side elevational view of the feeder illustrating a gripping assembly disposed in an engagement position.
FIG. 4 is a schematic side elevational view of the feeder illustrating the gripping assembly disposed in an engagement position, with a side wall of the feeder cut away to show the position of a gripper relative to a stack of sheet material.
FIG. 5 is a schematic side elevational view of the feeder illustrating the gripping assembly disposed in a position intermediate the engagement position and a sheet releasing position, with the side wall of the feeder cut away to show the position of the gripper relative to the stack of sheet material.
FIG. 6 is a schematic side elevational view of the feeder illustrating the gripping assembly disposed in the sheet-releasing position, with the side wall of the feeder cut away to show the position of the gripper relative to the stack of sheet material.
FIG. 13 is a side elevational view of the gripping assembly illustrating a stop moving mechanism employed in the feeder of the present invention.
Figure 8:
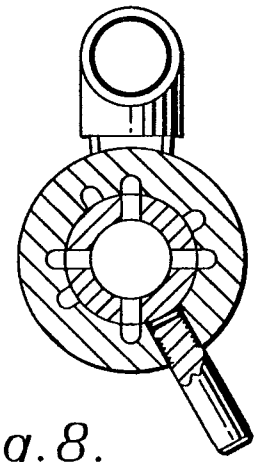
FIG. 8 is a side elevational view, partially in section, of the valve assembly taken along line 8—8 in FIG. 7.
Figure 7:
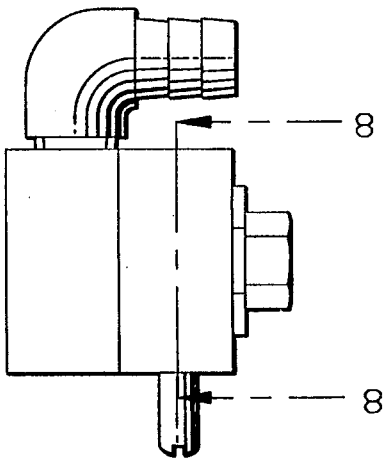
FIG. 7 is a rear elevational view of a valve assembly employed in the feeder of the present invention.

A feeder for use in feeding flexible sheet material, such as multiple sheet newspaper sections or the like, is illustrated in FIG. 1. The feeder includes a pair of side walls 20, 22 spaced apart by a distance sufficient to accommodate the sheet material, a receptacle 24 on which a stack of the sheet material is supported, and a number of delivery rollers 26, 28 positioned beneath the stack of sheet material and adapted to deliver the sheet material to a receiving station.

A gripping assembly 30 is provided on the feeder and is positioned to assist the movement of sheet material from the receptacle into the nip defined by the delivery rollers 26, 28 in order to ensure that the sheet material is delivered in a properly timed serial fashion.

The receptacle 24 for the sheet material includes a generally horizontal tray 32, and a transverse bar 34 which extends between the side walls 20, 22 and which includes a pair of upstanding marginal edge support assemblies 36. A laterally extending protruding tab 38 is provided on each support assembly and is adapted to support the marginal edge of a lowermost sheet of the stack retained in the receptacle.

As shown in FIG. 4, the height of the tabs 38 dictates the vertical position of the marginal edge 40 of the lowermost sheet of the stack and is adjustable in order to permit proper operation of the feeder. Also, the position of the marginal edge support assemblies 36 along the transverse bar may be adjusted.

The receptacle tray 32 is a generally flat plate extending between the side walls 20, 22 and includes a front edge 42 terminating above the lower delivery rollers 28 adjacent the nip defined between the delivery rollers 26, 28. A space is defined between the front edge of the receptacle tray and the marginal edge support assemblies which is large enough to permit the marginal edge of the lowermost sheet to be removed from the stack and directed toward the nip defined between the rollers 26, 28 in a manner described more fully below.

Turning to FIG. 2 the lower delivery rollers 28 are secured for rotation on a common shaft 44 extending between the side walls and adapted to be driven by conventional rotation transmitting means such as by a motor connected either directly to the shaft or to a gear drive arrangement or the like. The shaft 44, although rotatable relative to the side walls, does not reciprocate relative to the side walls during operation of the lower delivery rollers 28.

The upper delivery roller 26 is shown in FIG. 1, and includes a single roller supported on a shaft 46 which extends through a pair of openings 48 in the side walls. The shaft 46 is retained by a pair of arms 50 that are supported for pivotal movement relative to the side walls such that the shaft may be reciprocated toward and away from the lower delivery rollers 28 by pivoting the arms 50 relative to the side walls. Suitable bearing assemblies are provided on the shaft to permit rotation of the shaft relative to the arms.

The gripping assembly 30 includes a plurality of grippers 52 secured for movement with a hollow shaft 54 which extends through a pair of openings 56 in the side walls and which is fastened at each end to a rocker arm 58. Each rocker arm, in turn, is pivotally supported on one of the side walls for pivoting movement about an axis that is parallel to the axis of the hollow shaft but which is displaced from the shaft axis such that pivoting of the rocker arms 58 carries out reciprocation of the hollow shaft 54.

Each of the grippers 52 include a hollow arm 60 connected to the hollow shaft 54 and extending outward therefrom toward the nip defined between the delivery rollers 26, 28. Suction cups 62 are provided at the ends of the arms and communicate with the passage defined by the hollow shaft via the arms 60.

Figure 10:
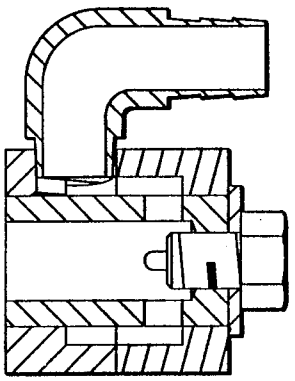
FIG. 10 is a front elevational view of the valve assembly, taken in section along line 10—10 in FIG. 9.

A valve assembly 64 is provided on the gripping assembly 30 for controlling the timing of application of a vacuum pressure to the suction cups 62. The valve assembly 64 is shown in FIG. 10, and includes a manifold 66 mounted on and movable with the hollow shaft 54. The manifold 66 includes an inner chamber 68 and an opening 70 adjacent one end thereof which communicates with the passage defined within the hollow shaft 54. A plurality of radially extending orifices 72 are formed in the manifold adjacent an end thereof opposite the opening 70.

A collar 74 is secured to the outer circumference of the manifold 66 adjacent the end thereof provided with the opening 70. The collar 74 includes an annular groove 76 extending around the outer circumference of the manifold 66. The annular groove 76 is positioned adjacent an end of the collar 74 such that the groove is exposed to a valve 78 that is accommodated on the outer surface of the manifold adjacent the collar. The collar 74 also includes a conduit or elbow 80 that extends outward from the collar and is in communication with the annular groove 76. The conduit 80 is adapted for connection to a conventional vacuum pressure supply such that a vacuum pressure may be continuously applied to the annular groove via the conduit.

The valve 78 overlies the plurality of orifices 72 in the manifold 66 and is retained on the manifold by a retainer 82 held against the manifold by a threaded securing member 84, the valve being rotatable relative to the manifold and the collar. The valve 78 includes a first plurality of channels 86 provided on the inner circumferential surface thereof which extend axially inward from the end of the valve adjacent the collar 74. This first plurality of valve channels 86 are adapted to align with and connect the orifices 72 in the manifold with the annular groove 76 formed in the collar when the valve is in a first rotary position relative to the manifold.

Figure 12:
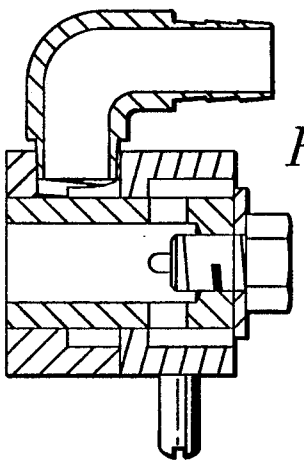
FIG. 12 is a front elevational view of the valve assembly, taken in section along line 12—12 in FIG. 11.

A second plurality of valve channels 88 are also formed in the valve, as shown in FIG. 12. The second plurality of valve channels 88 are also provided on the inner circumferential surface of the valve, but extend axially inward from the end of the valve positioned remote from the collar 74. This second plurality of valve channels 88 align with the orifices 72 in the manifold 66 when the valve is rotated to a second rotary position and connect the orifices with the atmosphere. A lever arm 90 extends radially outward from the valve and defines means for rotating the valve between the first and second positions.

During operation of the feeder, as shown in FIG. 4, a plurality of sheets or sections of sheet material 92 are retained in the receptacle 24 with the marginal edges of the sheets abutting the marginal edge support assemblies 36 such that the lowermost sheet spans the gap defined between the edge of the tray 32 and the tabs 38 of the support assemblies.

Figure 9:
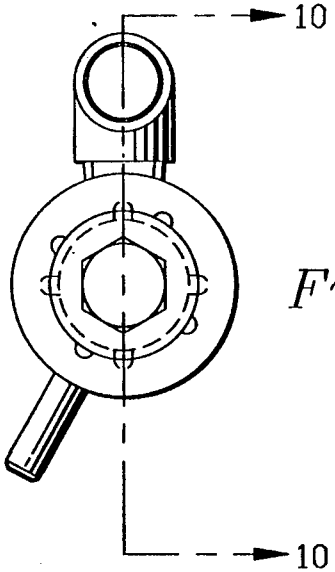
FIG. 9 is a side elevational view of the valve assembly illustrating a valve oriented in a closed position.

Conventional drive means are provided for pivoting the rocker arms 58 of the gripping assembly 30 such that the hollow shaft 54 and grippers 52 are moved through an arcuate path of travel from a position such as that shown in FIG. 6 to an engagement position such as that illustrated in FIG. 4. During this movement, the lever arm 90 of the valve 78 contacts a first stop 94 provided on the side wall 22 and is prevented from moving further along the arcuate path of travel such that rotation of the valve to the first position, as shown in FIGS. 9 and 10, is achieved. In this position of the valve, the first plurality of channels 86 connect the annular groove 76 of the collar 74 with the orifices 72 in the manifold 66 such that vacuum pressure is communicated between the conduit 80 and the inner chamber 68 of the manifold. Thus, a vacuum pressure is communicated to the hollow shaft 54 and grippers 52. The application of this vacuum pressure coincides with movement of the suction cups 62 into contact with the lower sheet of the stack such that the suction cups adhere to the lowermost sheet during continued application of the vacuum pressure.

Continued operation of the feeder drive means causes the rocker arms 58 to pivot, thus moving the shaft 54 and grippers 52 back through the arcuate path of travel toward a sheet-releasing position. During this movement of the gripping assembly 30, as shown in FIG. 5, the valve 78 remains in the first position so that the vacuum pressure at the suction cups 62 is maintained and the lowermost sheet or section is held by the suction cups and pulled downward until the marginal edge 40 clears the tabs 38 and is moved into the nip defined between the delivery rollers 26, 28.

Figure 11:
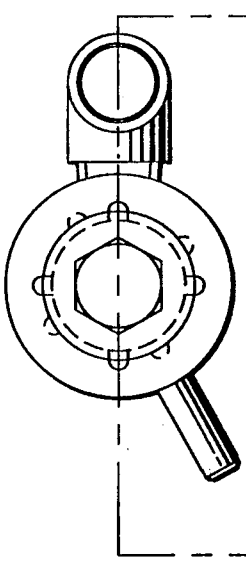
FIG. 11 is a side elevational view of the valve assembly illustrating a valve oriented in a open position.

As the gripping assembly 30 approaches the sheet-releasing position, the lever arm 90 contacts a second stop 96 provided on the side wall 22 causing rotation of the valve 78 toward the second position shown in FIGS. 11 and 12. As mentioned, in this second position, the inner chamber 68 of the manifold 66 is connected to atmosphere via the orifices 72 and second plurality of valve channels 88 so that the vacuum is dumped quickly to atmosphere. Returning to FIG. 6, the release of vacuum pressure within the inner chamber 68 causes the suction in cups 62 to cease, thus releasing the sheet or section.

The drive means used to carry out reciprocation of the gripping assembly 30 also carries out reciprocation of the upper delivery roller 26 toward and away from the lower delivery rollers 28. Thus, as the gripping assembly 30 is moved toward the sheet releasing position, the upper delivery roller 26 is reciprocated toward the lower delivery rollers 28. As the lowermost sheet or section 92 is feed into the nip, the upper delivery roller 26 presses the sheet or section against the driven lower rollers 28 so that the sheet or section is pulled by the rollers 28 from the receptacle 24 and delivered to a delivery station 98.

Thereafter, the drive means reciprocates the gripping assembly 30 back to the engagement position, as shown in FIG. 4, and the feeding operation is repeated.

As shown in FIG. 3, the stops 94, 96 are secured to the apparatus within slots extending in a horizontal direction within the arcuate path of travel of the lever arm 90. The position of the stops within the slots is adjustable to permit the timing of contact between the arm and the stops to be varied in order to control point at which the vacuum pressure to the suction cups is turned on and off during travel of the grippers between the engagement and sheet releasing positions.

Another feature of the preferred embodiment of the present invention includes means for moving the first stop 94 out of the arcuate path of travel of the lever arm 90 so that the arm does not engage the stop during movement of the gripping assembly 30 through the arcuate path of travel to the engagement position and the valve is not rotated to the first position.

This stop moving means is illustrated in FIG. 3 and includes a mounting arm 100 pivotally supported on the side wall 22, and an electromagnetic actuator 102 fixed to the side wall and including an armature 104 connected to the mounting arm for pivoting the mounting arm upon energization of the actuator. The first stop 94 is secured to the mounting arm 100 such that when the mounting arm is pivoted by the electromagnetic actuator, as shown in FIG. 13, the first stop is moved out of the path of travel. In this manner, the valve 78 does not rotate to the first position as the gripping assembly reciprocates into and out of the engagement position, and no vacuum pressure is applied at the suction cups 62. Thus, the gripping assembly moves back to the sheet-releasing position without engaging the lowermost sheet or section, and no feeding of the sheet or section occurs.

Control means are provided for operating the stop moving means in response to a sensed signal representative of a condition requiring that the sheet material not be delivered from the feeder. For example, if a newspaper or the like which is to receive a sheet or section from the feeder is not present at the delivery station, a conventional sensor may be employed to sense this absence of the newspaper and to signal energization of the electromagnetic actuator.

It is to be understood that although the present invention has been described with reference to the illustrated preferred embodiment, it is possible to employ equivalents and substitutions thereof without departing from the scope of the invention as set forth in the claims.

What is claimed is:

1. A feeder for flexible sheet material comprising:

a frame;

a receptacle mounted on the frame for receiving and supporting a plurality of the sheets in stacked relationship;

a vacuum operated gripping assembly supported on the frame adjacent the receptacle and provided with a hollow gripper shaft defining a central passage and including a vacuum operated gripper communicating with the passage, the shaft being movable through an arcuate path of travel relative to the frame between an engagement position in which the gripper engages a marginal portion of an adjacent sheet of the stack and a sheet releasing position in which the marginal position of the adjacent sheet is pulled away from the stack without moving the remainder of the adjacent sheet;

a conveying unit having a pair of opposed, relatively shiftable delivery elements for receiving a sheet therebetween at the sheet releasing position of the gripper;

power means for moving the gripper shaft through the arcuate path of travel; and control means for controlling vacuum pressure to the gripper to cause the marginal portion of the adjacent sheet to be gripped by the gripper when the shaft is in the engagement position and to discontinue the vacuum to the gripper at the sheet releasing position, the control means including a vacuum line connected to a vacuum system and a valve disposed between the line and the hollow shaft and movable between open and closed positions, the valve being mounted for rotation on the gripping assembly, the control means including valve operating means for rotating the valve relative to the gripping assembly to the open position in response to movement of the shaft through the arcuate path of travel to the engagement position and for rotating the valve to the closed position in response to movement of the shaft to the sheet releasing position.

2. A feeder as recited in claim 1, wherein the valve is mounted for rotation about an axis substantially collinear with the axis defined by the hollow shaft, the valve moving with the hollow shaft through the arcuate path of travel during movement of the shaft between the engagement and sheet releasing positions.

3. A feeder as recited in claim 1, wherein the shaft is provided with a port extending between the passage and the valve, and the valve includes a first channel which connects the port with the line which the valve is rotated to the open position and the first channel is aligned with the port, and a second channel which connects the port with atmosphere when the valve is rotated to the closed position and the second channel is aligned with the port.

4. A feeder as recited in claim 1, wherein the valve operating means includes a first stop mounted on the frame and an arm supported on the valve, the stop being positioned relative to the arm within the arcuate path of travel for engaging the arm and rotating the valve relative to the gripping assembly to the open position in response to movement of the shaft through the arcuate path of travel to the engagement position.

5. A feeder as recited in claim 4, further including means for adjusting the position of the first stop within the path of travel in order to modify the timing of rotation of the valve during movement of the shaft through the arcuate path of travel.

6. A feeder as recited in claim 4, further comprising stop moving means for moving the first stop out of the arcuate path of travel so that the arm does not engage the stop during movement of the shaft through the arcuate path of travel to the engagement position and the valve is not rotated to the open position, and control means for operating the stop moving means in response to a sensed signal representative of a condition requiring that the sheet material not be delivered from the feeder.

7. A feeder as recited in claim 6, wherein the stop moving means includes a mounting arm pivotally supported on the frame, and a electromagnetic actuator fixed to the frame and including an armature connected to the mounting arm for pivoting the mounting arm upon energization of the actuator, the first stop being secured to the mounting arm such that when the mounting arm is pivoted by the electromagnetic actuator, the first stop is moved out of the path of travel.

8. A feeder as recited in claim 4, wherein the valve operation means includes a second stop mounted on the frame and being positioned relative to the arm within the arcuate path of travel for engaging the arm and rotating the valve to the closed position in response to movement of the shaft through the arcuate path of travel to the sheet releasing position.

9. A feeder as recited in claim 8, further including means for adjusting the position of the second stop within the path of travel in order to modify the timing of rotation of the valve during movement of the shaft through the arcuate path of travel.

10. A feeder as recited in claim 1, wherein the receptacle includes a horizontal tray on which the sheet material is supported and marginal edge support means for positioning the marginal edges of the sheet material within the receptacle.

11. A feeder as recited in claim 1, wherein the vacuum operated gripping assembly incudes a pair of rocker arms, each supported on the frame for rotation about a pivot axis, the shaft being supported on the rocker arms and being spaced from the pivot axis so that the shaft moves through the arcuate path of travel during rotation of the rocker arms about the pivot axis.

* * * * *